US006310593B1

(12) United States Patent
Nakao

(10) Patent No.: US 6,310,593 B1
(45) Date of Patent: Oct. 30, 2001

(54) LIQUID CRYSTAL DRIVING CIRCUIT

(75) Inventor: Tomoaki Nakao, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/290,612

(22) Filed: Apr. 13, 1999

(30) Foreign Application Priority Data

Apr. 13, 1998 (JP) ..... 10-101601

(51) Int. Cl.[7] ..... G09G 3/36

(52) U.S. Cl. ..... 345/87; 345/89; 345/211; 345/213

(58) Field of Search ..... 345/87, 88, 89, 345/211, 212, 213

(56) References Cited

U.S. PATENT DOCUMENTS 5,030,947 * 7/1991 Dieudonne et al. ..... 340/767
5,189,407 * 2/1993 Mano et al. ..... 340/793
5,495,287 * 2/1996 Kasai et al. ..... 345/89
5,610,626 * 3/1997 Kasai et al. ..... 345/89
5,859,632 * 1/1999 Ito ..... 345/211
5,929,847 * 7/1999 Yanagi et al. ..... 345/204
5,995,072 * 11/1999 Nakajima ..... 345/87
6,002,384 * 12/1999 Tamai et al. ..... 345/95
6,191,767 * 2/2001 Mano et al. ..... 345/90
6,236,394 * 5/2001 Ikeda ..... 345/211

FOREIGN PATENT DOCUMENTS 6-118908 4/1994 (JP) .

* cited by examiner

*Primary Examiner*—Regina Liang
*Assistant Examiner*—Kimnhung Nguyen

(57) ABSTRACT

A liquid crystal driving circuit includes: a charge capacitor and a distribution capacitor, each having a first electrode and a second electrode, respective first electrodes of the charge capacitor and the distribution capacitor being connected to each other; a first switch for connecting and disconnecting respective second electrodes of the charge capacitor and the distribution capacitor; a select switch for selecting application of a first reference voltage and a second reference voltage with respect to the second electrode of the charge capacitor by connection or disconnection; an operational amplifier for outputting an analog signal for multi-tone display in accordance with an amount of charge of the distribution capacitor and the second reference voltage; and a controller for alternately controlling the first switch and the select switch in accordance with a digital signal for multi-tone display.

9 Claims, 14 Drawing Sheets

CHARGE CAPACITOR 4
DISTRIBUTION CAPACITOR 5
TOTAL CAPACITANCE
C1
C2

1
1
INITIAL STATE
1

FIRST TIME
①
1
1
C1=1 BECAUSE D0=1
1 + 1 = 2
②
2/2
2/2
EQUALLY DISTRIBUTE (FIRST TIME)
2/2

SECOND TIME
①
0
2/2
C1=0 BECAUSE D1=0
0 + 2/2 = 2/2
②
2/4
2/4
EQUALLY DISTRIBUTE (SECOND TIME)
2/4

THIRD TIME
①
1
2/4
C1=1 BECAUSE D2=1
1 + 2/4 = 6/4
②
6/8
6/8
EQUALLY DISTRIBUTE (THIRD TIME)
6/8

FOURTH TIME
①
0
6/8
C1=0 BECAUSE D3=0
0 + 6/8 = 6/8
②
6/16
6/16
EQUALLY DISTRIBUTE (FOURTH TIME)
6/16

CHARGE CAPACITOR 4
DISTRIBUTION CAPACITOR 5
TOTAL CAPACITANCE
C1
C2

0
0
INITIAL STATE
0

FIRST TIME
①
1
0
C1=1 BECAUSE D0=1
1 + 0 = 1
②
1/2
1/2
EQUALLY DISTRIBUTE (FIRST TIME)
1/2

SECOND TIME
①
0
1/2
C1=0 BECAUSE D1=0
0 + 1/2 = 1/2
②
1/4
1/4
EQUALLY DISTRIBUTE (SECOND TIME)
1/4

THIRD TIME
①
1
1/4
C1=1 BECAUSE D2=1
1 + 1/4 = 5/4
②
5/8
5/8
EQUALLY DISTRIBUTE (THIRD TIME)
5/8

FOURTH TIME
①
0
5/8
C1=0 BECAUSE D3=0
0 + 5/8 = 5/8
②
5/16
5/16
EQUALLY DISTRIBUTE (FOURTH TIME)
5/16

CHARGE CAPACITOR 4
DISTRIBUTION CAPACITOR 5
TOTAL CAPACITANCE
C1
C2

1
1
INITIAL STATE
1

FIRST TIME
①
1
1
C1=1 BECAUSE D0=1
1 + 1 = 2
②
2/2
2/2
EQUALLY DISTRIBUTE (FIRST TIME)
2/2

SECOND TIME
①
0
2/2
C1=0 BECAUSE D1=0
0 + 2/2 = 2/2
②
2/4
2/4
EQUALLY DISTRIBUTE (SECOND TIME)
2/4

THIRD TIME
①
1
2/4
C1=1 BECAUSE D2=1
1 + 2/4 = 6/4
②
6/8
6/8
EQUALLY DISTRIBUTE (THIRD TIME)
6/8

CHARGE CAPACITOR 4
DISTRIBUTION CAPACITOR 5
TOTAL CAPACITANCE
C1
C2

0
0
INITIAL STATE
0

FIRST TIME
①
1
0
C1=1 BECAUSE D0=1
1 + 0 = 1
②
1/2
1/2
EQUALLY DISTRIBUTE (FIRST TIME)
1/2

SECOND TIME
①
0
1/2
C1=0 BECAUSE D1=0
0 + 1/2 = 1/2
②
1/4
1/4
EQUALLY DISTRIBUTE (SECOND TIME)
1/4

THIRD TIME
①
1
1/4
C1=1 BECAUSE D2=1
1 + 1/4 = 5/4
②
5/8
5/8
EQUALLY DISTRIBUTE (THIRD TIME)
5/8

LIQUID CRYSTAL DRIVING CIRCUIT

FIELD OF THE INVENTION

The present invention relates to a liquid crystal driving circuit for carrying out multi-tone display in liquid crystal display devices, etc., and particularly relates to a liquid crystal driving circuit for use in an active-matrix liquid crystal display device.

BACKGROUND OF THE INVENTION

A conventional liquid crystal driving circuit for carrying out multi-tone display in a liquid crystal display device is disclosed, for example, in Japanese Unexamined Patent Publication No. 118908/1994 (Tokukaihei 6-118908) (published on Apr. 28, 1994). This liquid crystal driving circuit outputs an analog voltage which has been subjected to γ correction, which shows a kinked characteristic in accordance with the optical characteristic of a liquid crystal material in accordance with tone levels. FIG. 15 shows a circuit structure which realizes multi-tone display by this driving technique. A liquid crystal driving circuit of FIG. 15 has a digital signal input of 6 bits and a single analog signal output, and converts a digital signal for multi-tone display into an analog signal for carrying out multi-tone display on a liquid crystal panel so as to output the analog signal thus converted.

This liquid crystal driving circuit includes a reference voltage input terminal 21, an analog switching element 22, an analog switching element 23, a capacitor alley 24, analog switching elements 25*a* and 25*b*, an adjuster capacitor 26, a feedback capacitor 27, and an operational amplifier 28. The reference voltage input terminal 21 is a terminal for inputting a plurality of reference voltages. The analog switching element 22 is turned ON or turned OFF by the upper two bits of the input digital signal, and the analog switching element 23 is turned ON or turned OFF by the lower four bits of the input digital signal. The capacitor alley 24 is weighted $2^0$ to $2^3$ times a basic capacitance. The analog switching elements 25*a* and 25*b* carry out initialization of a digital/analog conversion circuit. The adjuster capacitor 26 has the capacitance $2^0$ times the basic capacitance, and the feedback capacitor 27 has the capacitance $2^4$ times the basic capacitance. The operational amplifier 28 is a differential amplifier circuit. The analog switching elements 22, 23, 25*a* and 25*b* are all composed of MOS transistors.

The following briefly explains the operation of the above liquid crystal driving circuit. The input voltages from the reference voltage input terminal 21 are selected by the analog switching element 22, which is turned ON or turned OFF by the upper two bits of the input digital signal so that only adjacent two voltages are outputted to the analog switching element 23.

The analog switching element 23, upon receiving the reference voltages, sends only one of the reference voltages to the capacitor alley 24 in accordance with the lower four bits of the input digital signal.

The analog switching elements 25*a* and 25*b* provided for initialization carry out initialization in such a manner that all SW-A are turned ON and all SW-B are turned OFF during initialization so that the charges in the capacitors are all discharged. Thereafter, in the subsequent digital-analog conversion (hereinafter simply "DA conversion"), SW-A are all turned OFF and SW-B are all turned ON.

The reference voltage selected by the analog switching element 23 is applied to one terminal of each capacitor of the capacitor alley 24, resulting in a potential change. This sets off redistribution of charges among the capacitor alley 24, the adjuster capacitor 26, and the feedback capacitor 27. The capacitance of each capacitor of the capacitor alley 24 is set beforehand to the value $2^0$ to $23^3$ times the basic capacitance in accordance with the weighting of the input digital signal, and therefore the output voltage Vout after conversion takes the form of an analog voltage in accordance with the digital bits of the input digital signal.

In the described liquid crystal driving circuit, while lower four bits of the input digital signal are subjected to linear DA conversion, the upper two bits thereof are used to select the reference voltage. Thus, due to the fact that a kinked voltage having different DA conversion characteristics per $2^4$=16 tones can be outputted by arbitrarily setting an intermediate voltage of each input reference voltage, it is possible to output an analog voltage which has been subjected to γ correction, in accordance with the optical characteristic of the liquid crystal material.

In recent years, faced with a strong demand for finer liquid crystal panels capable of displaying more multi-tones, the competition for cutting down the cost of liquid crystal modules including the liquid crystal panel has not been higher. As a result, there also has been a strong demand for reducing the cost of a driving circuit for driving the liquid crystal panel, which is one of the peripheral devices other than the liquid crystal panel.

However, with the conventional driving circuit such as the one shown in FIG. 15, as the number of tones of a multi-tone liquid crystal panel is increased, the total capacitance of the capacitor alley 24 and the number of capacitors are inevitably increased. This increases the size of the driving circuit geometrically, resulting in an abrupt increase in chip size when integrated and a large increase in cost.

For example, in the circuit of FIG. 15, the total capacitance required for a single output circuit becomes 32 times that of the basic capacitance ($2^0+2^0+2^1+2^2+2^3+2^4=1+1+2+4+8+16=32$). Also, in this circuit, it is important to consider the relative accuracy between capacitance values to make sure the accuracy of DA conversion, and in order to realize accurate weighting ratio, it is required to provide a basic capacitance exceeding a certain value, taking into consideration the product dispersion.

Therefore, referring back to the 6-bit circuit of FIG. 15 as an example, in order to increase the number of bits of the digital signal to realize further multi-tones, it is required to abruptly set large values to the total capacitance of the capacitor alley 24 and to the capacitance of the feedback capacitor 27, resulting in an increase in chip size of the LSI and an increase in cost.

Also, for example, in the above conventional art, in the case of using the lower four bits of a digital signal carrying information of multi-tone display for DA conversion, it is required to provide four capacitors in the capacitor alley 24. That is, it is required to provide m capacitors for lower m bits of a digital signal (m is an integer of not less than 1), and for this reason, as the number of tones is increased in a multi-tone liquid crystal panel, the number of capacitors is also inevitably increased, resulting in an abrupt increase in chip size and a large increase in cost.

SUMMARY OF THE INVENTION

It is an object of the present invention to provide a liquid crystal driving circuit capable of obtaining an analog output by DA conversion even in multi-tones without conventional problems such as an increase in total capacitance and total number of capacitors and a corresponding increase in chip size and cost.

In order to achieve this object, a liquid crystal driving circuit of the present invention includes: a plurality of reference voltage input terminals for inputting a plurality of respective reference voltages; a reference voltage selecting section for selecting and outputting a first reference voltage and a second reference voltage from the plurality of reference voltages, using a digital signal of N bits for multi-tone display; a first capacitor and a second capacitor, whose respective first electrodes are connected to each other; a first switch for connecting and disconnecting respective second electrodes of the first capacitor and the second capacitor, which are not connected to each other; a select switch for selecting and applying one of the first reference voltage and the second reference voltage to the second electrode of the first capacitor in accordance with the digital signal; a second switch for connecting and disconnecting the second reference voltage with respect to the respective first electrodes of the first capacitor and the second capacitor; a differential amplifier circuit, whose non-inverted input terminal is connected to the second reference voltage, for outputting from an output terminal an analog signal for multi-tone display that is in accordance with the digital signal; a feedback capacitor, whose one electrode is connected to an inverted input terminal of the differential amplifier circuit; a third switch for connecting and disconnecting an other electrode of the feedback capacitor with respect to the respective first electrodes of the first capacitor and the second capacitor; a fourth switch for connecting and disconnecting the other electrode of the feedback capacitor with respect to the non-inverted input terminal of the differential amplifier circuit; a fifth switch for connecting and disconnecting the output terminal of the differential amplifier circuit with respect to the inverted input terminal thereof; and a sixth switch for connecting and disconnecting the second electrode of the second capacitor with respect to the output terminal of the differential amplifier circuit.

With this arrangement, for example, by alternately operating (connecting or disconnecting) the first switch and the select switch by serially inputting a digital signal under the condition that the second, fourth, and fifth switches are closed and the third and sixth switches are opened, charging or discharging of the first capacitor is carried out and the charge is distributed between the first capacitor and the second capacitor, thereby storing in the second capacitor an amount of charge corresponding to a digital signal indicative of a degree of multi-tones.

Also, with the described arrangement, by opening the second, fourth, and fifth switches and by closing the third and sixth switches, it is possible to output an analog signal corresponding to the amount of charge stored in the second capacitor and in the feedback capacitor from the differential amplifier circuit.

Therefore, with the described arrangement, it is possible to carry out DA conversion in which a multi-tone analog signal in accordance with the digital signal is outputted from the differential amplifier circuit, for example, using only the first capacitor and the second capacitor having the same capacitance, thus preventing an increase in size and cost of the circuit even when further multi-tones are realized.

Further, with the above arrangement, because the first reference voltage and the second reference voltage, which are used in DA conversion, are selected by the reference voltage selecting section, for example, using the upper bits of the digital signal, it is possible to set a potential difference between the first reference voltage and the second reference voltage differently, allowing DA conversion with a kinked characteristic corresponding to the optical characteristic of the liquid crystal material.

As a result, with the above arrangement, the analog signal for multi-tone display can be obtained using the digital signal and using only two capacitors, for example, the first capacitor and the second capacitor having the same capacitance, thereby preventing conventional problems such as an increase in total capacitance and total number of capacitors and an increase in cost.

It is preferable that in the liquid crystal driving circuit of the present invention, the reference voltage is generated by at least one resistance which is provided between at least two terminals of the reference voltage input terminals.

With this arrangement, the reference voltage input terminals are connected to one another by at least one resistance, and a reference voltage is given to a minimum of two reference voltage input terminals. This allows DA conversion with a kinked characteristic corresponding to the optical characteristic of the liquid crystal material and simplifies the structure of an external power source circuit, thus further reducing costs.

It is preferable that the liquid crystal driving circuit of the present invention further includes a seventh switch for connecting and disconnecting the output terminal of the differential amplifier circuit with respect to the liquid crystal panel to be driven.

With this arrangement, by turning OFF the seventh switch between the output terminal of the differential amplifier circuit and the liquid crystal panel, the load of the differential amplifier circuit is separated from the load of the liquid crystal panel, thus allowing fast DA conversion free from the load all the time.

It is preferable that in the liquid crystal driving circuit of the present invention, the reference voltage selecting section selects the first reference voltage and the second reference voltage by upper M bits of the digital signal of N bits (N>M), and the select switch selects one of the first reference voltage and the second reference voltage by remaining (N−N) bits of the N bit digital signal.

With this arrangement, the first reference voltage and the second reference voltage are selected before DA conversion, thus further ensuring DA conversion with a kinked characteristic corresponding to the optical characteristic of the liquid crystal material.

It is preferable that in the liquid crystal driving circuit of the present invention, the select switch comes into operation serially with respect to the first switch.

With this arrangement, the select switch is operated serially with respect to the first switch, that is, alternately with the first switch with time. This ensures (i) charging and discharging of the first capacitor by the select switch and (ii) a distribution of charge between the first capacitor and the second capacitor by the first switch, thus further stabilizing DA conversion.

In order to achieve the foregoing object, the liquid crystal driving circuit of the present invention includes: a first capacitor and a second capacitor, each having a first electrode and a second electrode, for storing charge by application of a voltage, respective first electrodes of the first capacitor and the second capacitor being connected to each other; a first switch for connecting and disconnecting respective second electrodes of the first capacitor and the second capacitor; a select switch for selecting application of a first reference voltage and a second reference voltage applied to the first electrode of the first capacitor with respect to the second electrode of the first capacitor by connection and disconnection; a conversion circuit for outputting an analog signal for multi-tone display in accordance with an amount of charge of the second capacitor and in accordance with the second reference voltage; and switch controlling section for alternately controlling the first switch and the select switch in accordance with a digital signal for multi-tone display.

With this arrangement, the switch controlling section alternately controls the first switch and the select switch in accordance with the digital signal for multi-tone display, and, for example, alternately repeats charging or discharging of the first capacitor and distribution of charge between the first capacitor and the second capacitor, thereby outputting an analog signal in accordance with the digital signal, that varies with the amount of charge and the second reference voltage.

Therefore, with the above arrangement, by alternately controlling the first switch and the select switch by a serial input of the digital signal, it is possible to carry out DA conversion in which a multi-tone analog signal in accordance with the digital signal is outputted from the conversion circuit.

As a result, with the above arrangement, it is possible to carry out DA conversion with a serial digital signal using only two capacitors, the first capacitor and the second capacitor, thus preventing an increase in size and cost of the circuit even when multi-tone display is realized.

It is preferable that the liquid crystal driving circuit of the present invention further includes a reference voltage selecting section for changing setting of the first reference voltage and the second reference voltage in accordance with the digital signal so as to output the first reference voltage and the second reference voltage.

With this arrangement, the first reference voltage and the second reference voltage, which are used in DA conversion, can be changed by the reference voltage selecting section using, for example, the upper bits of the digital signal, thus realizing DA conversion with a kinked characteristic corresponding to the optical characteristic of the liquid crystal material.

For a fuller understanding of the nature and advantages of the invention, reference should be made to the ensuing detailed description taken in conjunction with the accompanying drawings.

DESCRIPTION OF THE EMBODIMENTS

The following will describe one embodiment of the present invention referring to FIG. 1 through FIG. 14.

Figure 1:
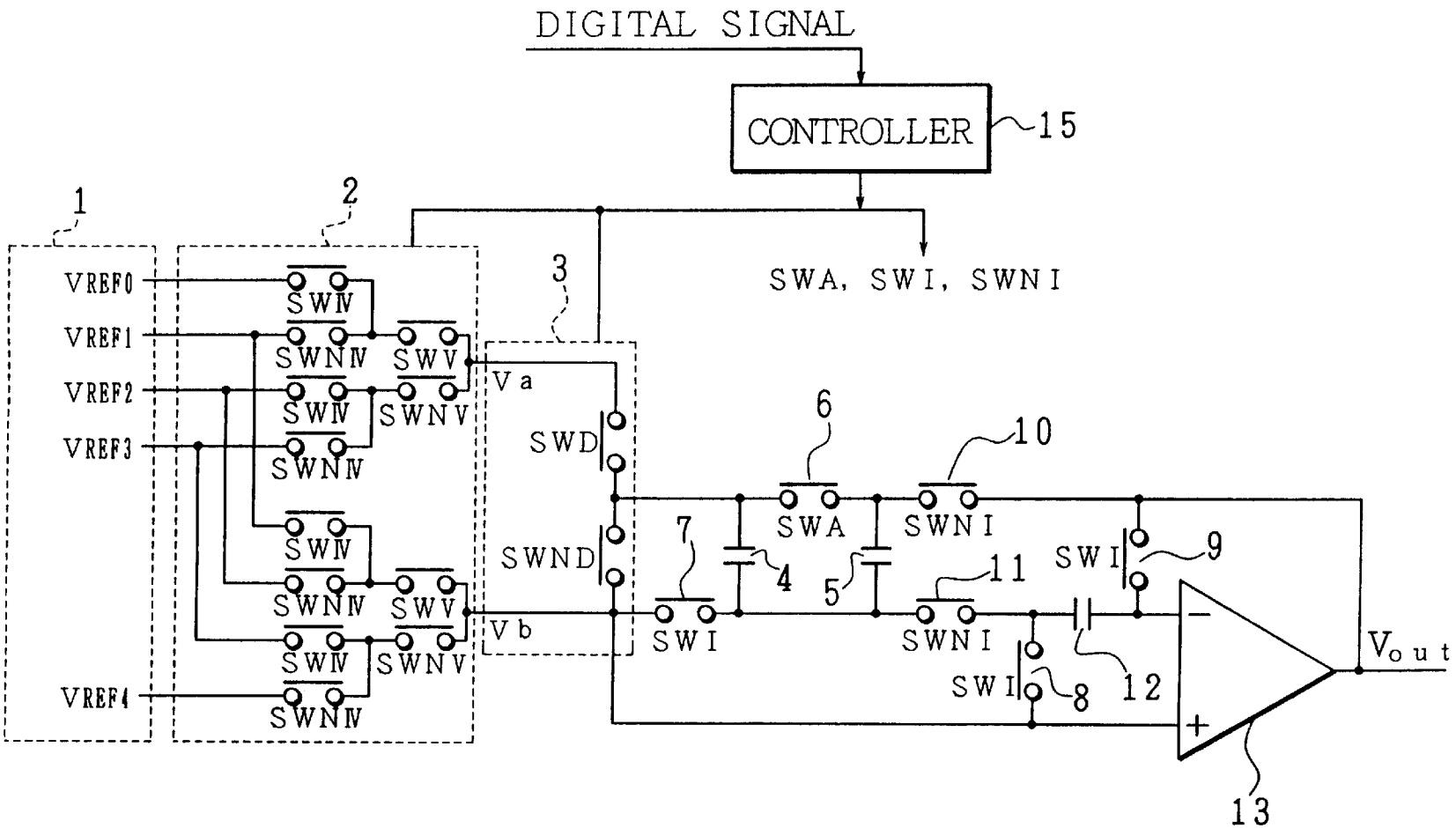
FIG. 1 is a circuit diagram of a liquid crystal driving circuit of the present invention.

A liquid crystal driving circuit in accordance with the present invention is a DA conversion circuit for converting a digital signal for multi-tone display into an analog signal for carrying out multi-tone display on a liquid crystal panel, which outputs the analog signal thus converted so as to drive the liquid crystal panel of a liquid crystal display device in multi-tones. For example, the liquid crystal driving circuit of the present invention takes the form of a DA conversion circuit as shown in FIG. 1, which includes an input of 6-bit digital signal as serial data, and an output of a single analog signal. Note that, the structure of the liquid crystal driving circuit, other than the part described below, is well-known and explanations thereof are omitted in the present embodiment.

The DA conversion circuit of the present embodiment is provided with a reference voltage input terminal 1, reference voltage selecting means 2, a select switch (selecting means) 3, a charge capacitor (first capacitor) 4, and a distribution capacitor (second capacitor) 5. The reference voltage selecting means 2 is a switch which is turned ON or turned OFF by the upper 2 bits of an input digital signal, and the select switch 3 is a switch which is turned ON or turned OFF by the lower 4 bits of the input digital signal. The charge capacitor 4 has the value of a basic capacitance, and the distribution capacitor 5 has the same capacitance as that of the charge capacitor 4. The charge capacitor 4 and the distribution capacitor 5 are capacitors for storing charge by the potential difference between their respective electrodes (first electrodes and second electrodes), that is, by the application of a voltage.

The DA conversion circuit further includes a first switch (distributing means) 6, an operational amplifier (differential amplifier circuit, conversion circuit) 13, and a controller (switch controlling means) 15. The first switch 6 is for carrying out converting operation of the DA conversion circuit. The operational amplifier 13 outputs an analog signal for multi-tone display in accordance with the amount of charge stored in the distribution capacitor 5. The controller 15 carries out a control in accordance with the digital signal so that the first switch 6 and the select switch 3 are operated (connected or disconnected) alternately.

The DA conversion circuit also includes a second switch 7, a third switch 11, a fourth switch 8, a fifth switch 9, and a sixth switch 10, all for initialization of the DA conversion circuit, and a correction capacitor (feedback capacitor) 12.

When carrying out DA conversion for multi-tone display, the controller 15 connects and disconnects the switches 7 to 11 independently when DA conversion is carried out and when it is not carried out. The switches 2, 3, and 6 to 11 are all analog switching elements composed of MOS transistors.

Figure 2:
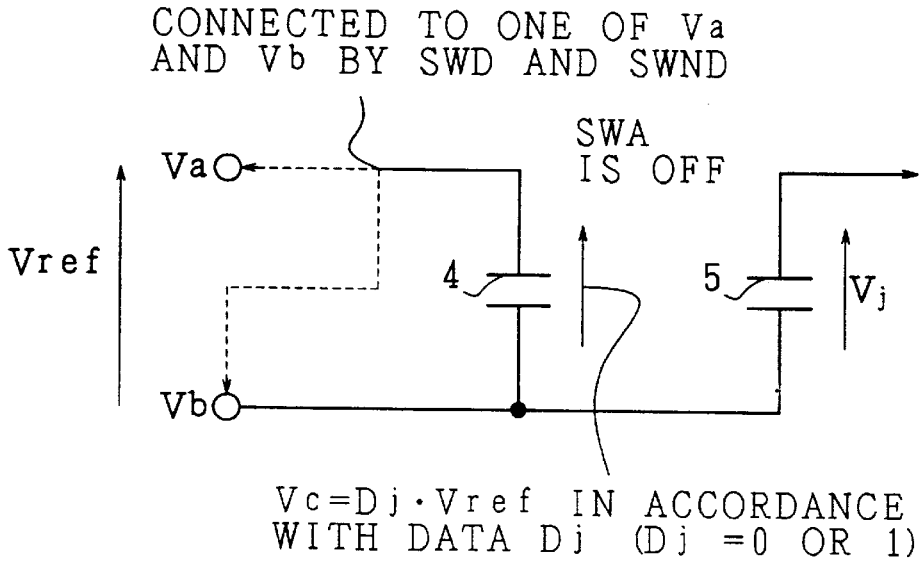
FIG. 2 is an explanatory drawing showing how a charge capacitor of the liquid crystal driving circuit is charged or discharged.
Figure 3:
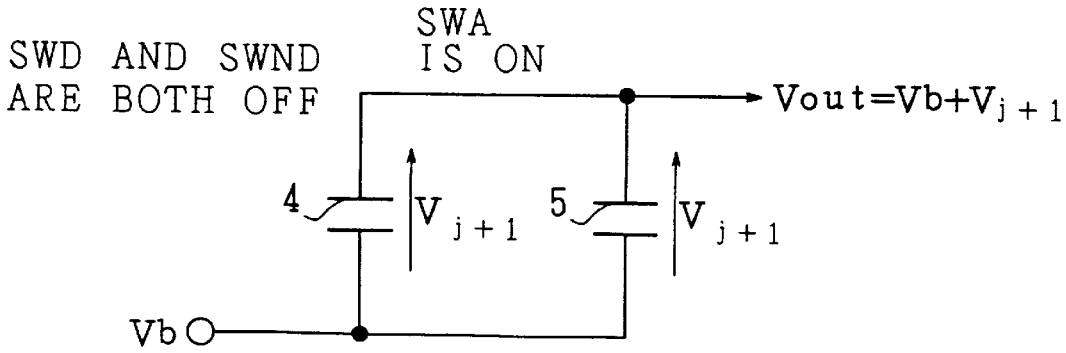
FIG. 3 is an explanatory drawing showing a distribution of charge between the charge capacitor and a distribution capacitor of the liquid crystal driving circuit.
Figure 4:
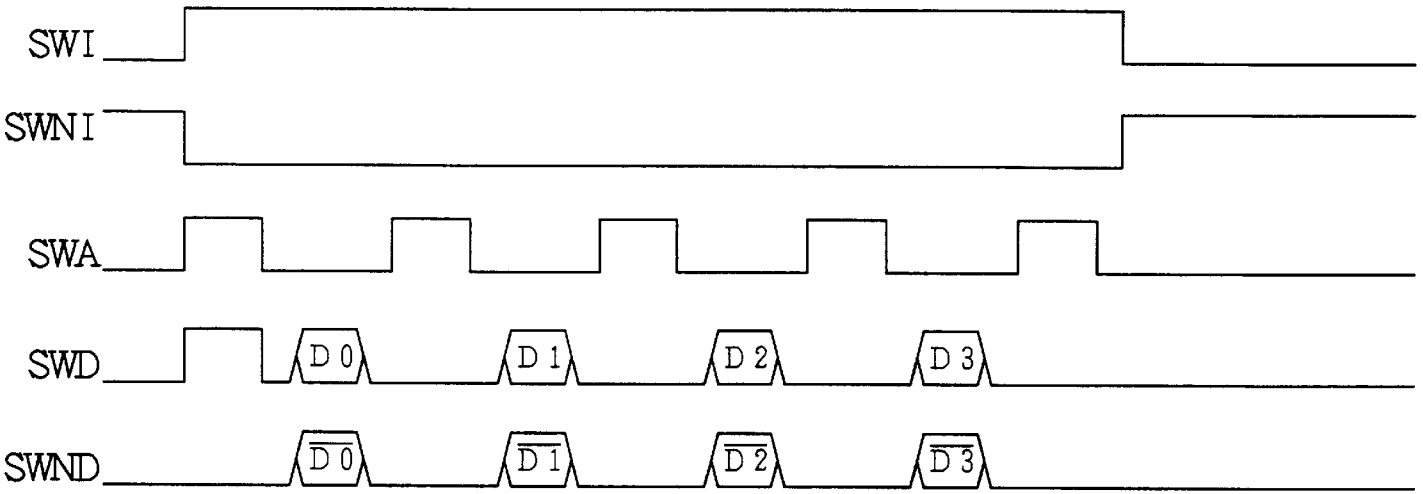
FIG. 4(*a*) through FIG. 4(*e*) are timing chart showing an operation example of the liquid crystal driving circuit.

FIG. 2 and FIG. 3 show a main section of the DA conversion circuit of FIG. 1, and the following describes how it operates. FIG. 4 is a timing chart of the DA conversion circuit of FIG. 1. The reference signs in FIG. 4 are corresponding to the reference signs of the switching elements of FIG. 1.

The following describes the operation of the liquid crystal driving circuit in detail. Here, the explanations are based on the case where positive logic is adopted to operate the switches so that all switches are turned ON when the signal is "H" level. However, as is widely known, the switches operate in the same manner with negative logic.

In FIG. 1, among the switches of the reference voltage selecting means 2, to SWV is inputted a signal of the first bit from the top of the input digital signal of 6 bits, indicating "H" or "L". To SWNV is inputted the inverse signal of the signal of the first bit of the input digital signal. In the same manner, to SWIV is inputted a signal of the second bit from the top of the input digital signal, and to SWNIV is inputted the inverse signal of the signal of the second bit of the input digital signal.

These switches constitute a reference voltage selecting circuit, and from five reference voltages inputted from the reference voltage input terminal 1, adjacent two voltages, which are determined by the first and second bits of the digital signal, are outputted to the select switch 3 by the switches of the reference voltage selecting means 2. Here, one of the two reference voltages is denoted as Va (first reference voltage) and the other is denoted as Vb (second reference voltage).

Figure 14:
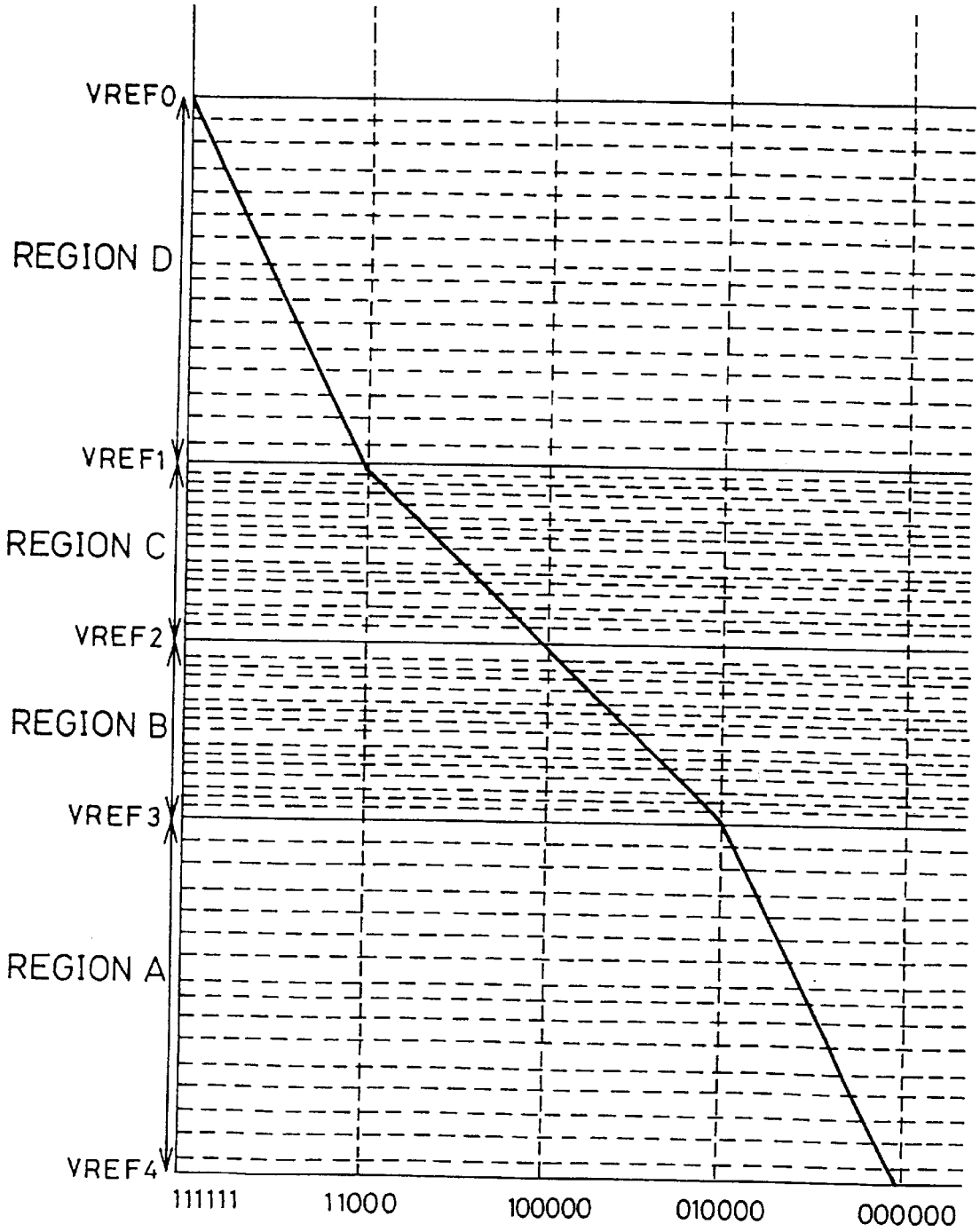
FIG. 14 is a graph showing a kinked characteristic of an analog signal obtained by the liquid crystal driving circuit.
Figure 15:
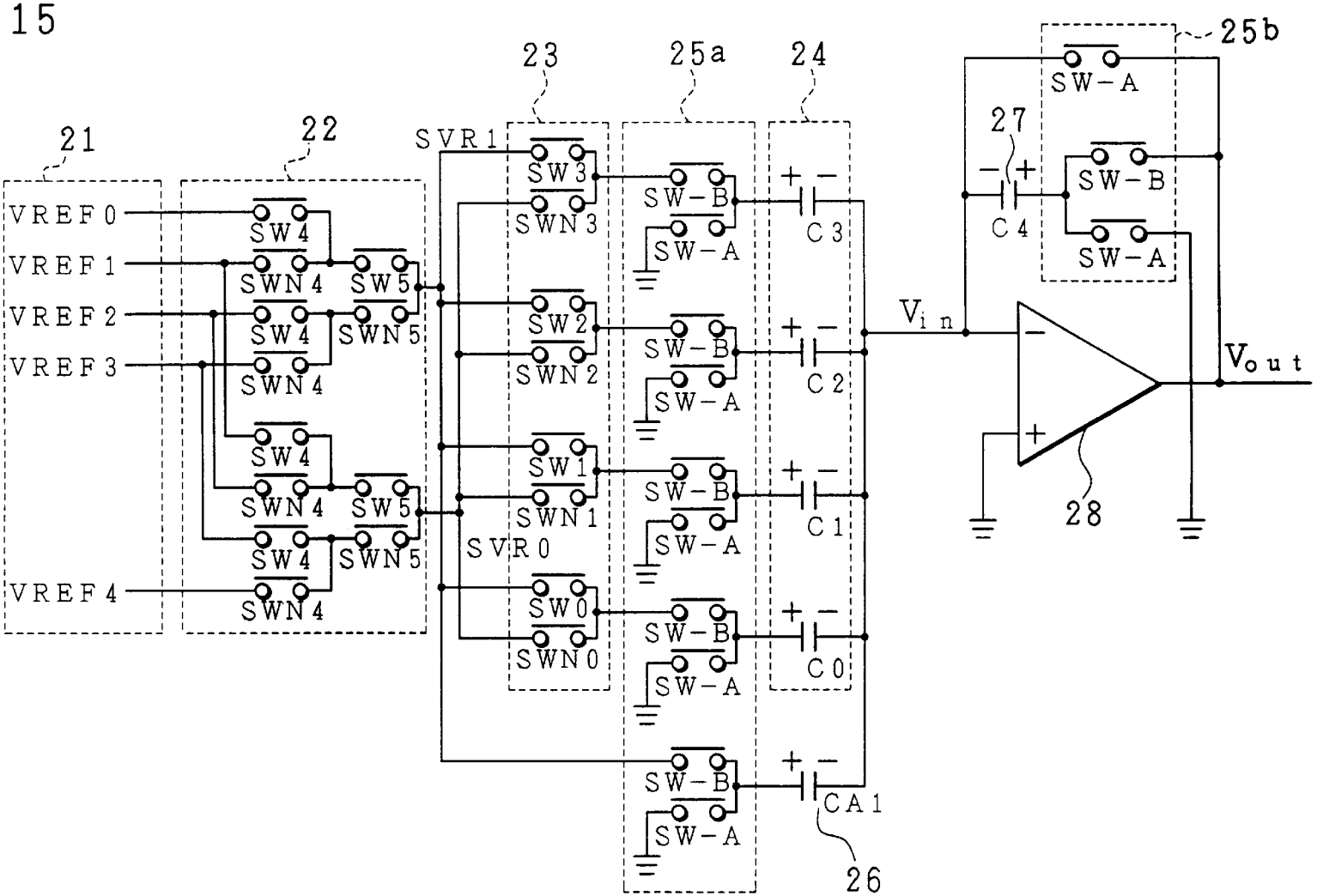
PRIOR ART FIG. 15
FIG. 15 is a circuit diagram of a conventional liquid crystal driving circuit.

In this manner, the upper two bits of the digital signal determine regions A through D as shown in FIG. 14, which are combinations of the reference voltages VREF0 VREF 4 adjacent to one another, as shown in Table 1.

TABLE 1

| UPPER 2 BITS | | Va | Vb | REGION IN FIG. 14 |
|---|---|---|---|---|
| 0 | 0 | VREF3 | VREF4 | A |
| 0 | 1 | VREF2 | VREF3 | B |
| 1 | 0 | VREF1 | VREF2 | C |
| 1 | 1 | VREF0 | VREF1 | D |

Then, to SWI of the switches 7 to 11 is given an ON signal during DA conversion, and they are turned OFF immediately after the completion of DA conversion. Inversely, to SWNI of the switches 7 to 11 is given an OFF signal in synchronization with the operation of SWI during DA conversion, and they are turned ON after the conversion. Meanwhile, SWA, as the switch 6, is first turned ON once for a duration shorter than the ON duration of SWI, in synchronization with the ON state of SWI, and after turned OFF once, turned ON again four more times in response to corresponding four pulses during the ON state of SWI, that is, during DA conversion.

SWD and SWND as the select switch 3 are turned ON or turned OFF with respect to successive bit 0 to bit 3 of the input digital signal before SWA is turned ON by four pulses during DA conversion. When the data of each bit is "H", SWD is turned ON and SWND remains OFF, and when the data of each bit is "L", SWND is turned ON and SWD remains OFF.

The following describes a DA conversion operation in accordance with the operation of the timing chart of FIG. 4, referring to FIG. 2 and FIG. 3. Here, it is assumed that VREF=Va−Vb in FIG. 2, and that the bit j of digital data is Dj (j=0, 1, 2, 3).

Here, Dj takes the integer value of "1" when the data are "H", and the integer value of "0" when the data are "L". FIG. 2 is the state in which SWA is turned OFF and the digital data Dj is given to each of SWD and SWND. Here, the voltage of the distribution capacitor 5 is Vj. The voltage, that is, the potential difference between both terminals of the charge capacitor 4 is VREF when Dj=1, and is 0 when Dj=0.

Thus, the voltage Vc between the both terminals of the charge capacitor 4 is represented by Vc=Dj·VREF. Since the voltage of the distribution capacitor 5 is Vj, when the capacitance of the charge capacitor 4 and the distribution capacitor 5 is $C_0$, the amount of charge $Q_{4J}$ and the amount of charge $Q_{5J}$ stored in the charge capacitor 4 and the distribution capacitor 5, respectively, are given by the following equations.

$$Q_{4J}=C_0 \cdot Dj \cdot VREF$$

$$Q_{5J}=C_0 \cdot Vj$$

FIG. 3 is the state in which SWD and SWND are both turned OFF and SWA is turned ON. Here, when the voltage of the charge capacitor 4 and the distribution capacitor 5 are $V_{j+1}$, from the law of conservation of charge, the following equation is obtained.

$$Q_{4J}+Q_{5J}=C_O \cdot Dj \cdot VREF+C_0 \cdot Vj=2C_0 \cdot V_{j+1}$$

This can be rearranged to give the following recurrence formula (1).

$$V_{j+1} = \frac{1}{2}Vj + \frac{1}{2}Dj \cdot VREF \tag{1}$$

By determining a general term from this recurrence formula (1), the following equation (2) is obtained.

$$Vn = \left(\frac{1}{2}\right)^n V0 + VREF \sum_{i=0}^{n-1} \left\{\left(\frac{1}{2}\right)^{n-i} \cdot Di\right\} \tag{2}$$

Here, $V_0$ is the initial voltage of the distribution capacitor 5, and n is the number of bits to be subjected to DA conversion, which is set to 4 in the present embodiment. The above recurrence formula (2) can be rewritten as follows when initialization is carried out by simultaneously turning ON SWA and SWD, as shown in FIG. 4, and when $V_0$= VREF is given as the initial value of $V_0$.

$$V4 = VREF\left(\frac{1}{2}D3 + \frac{1}{4}D2 + \frac{1}{8}D1 + \frac{1}{16}D0 + \frac{1}{16}\right)$$

Figure 6:
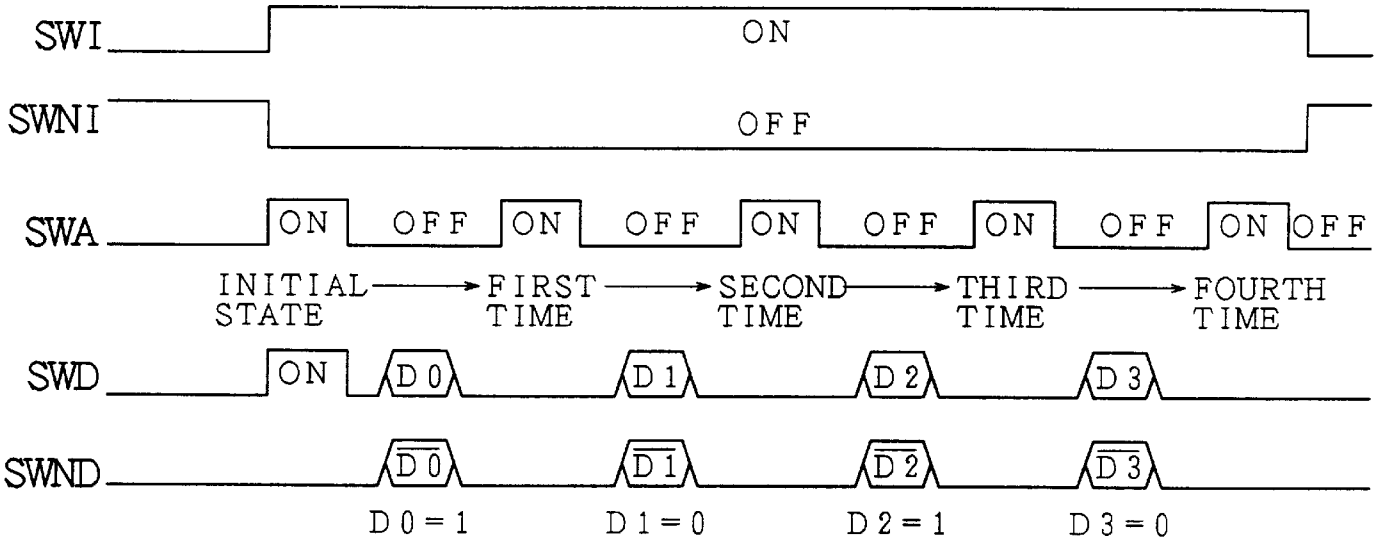
FIG. 6(*a*) through FIG. 6(*e*) are timing chart showing an operation example of the liquid crystal driving circuit.
Figure 7:
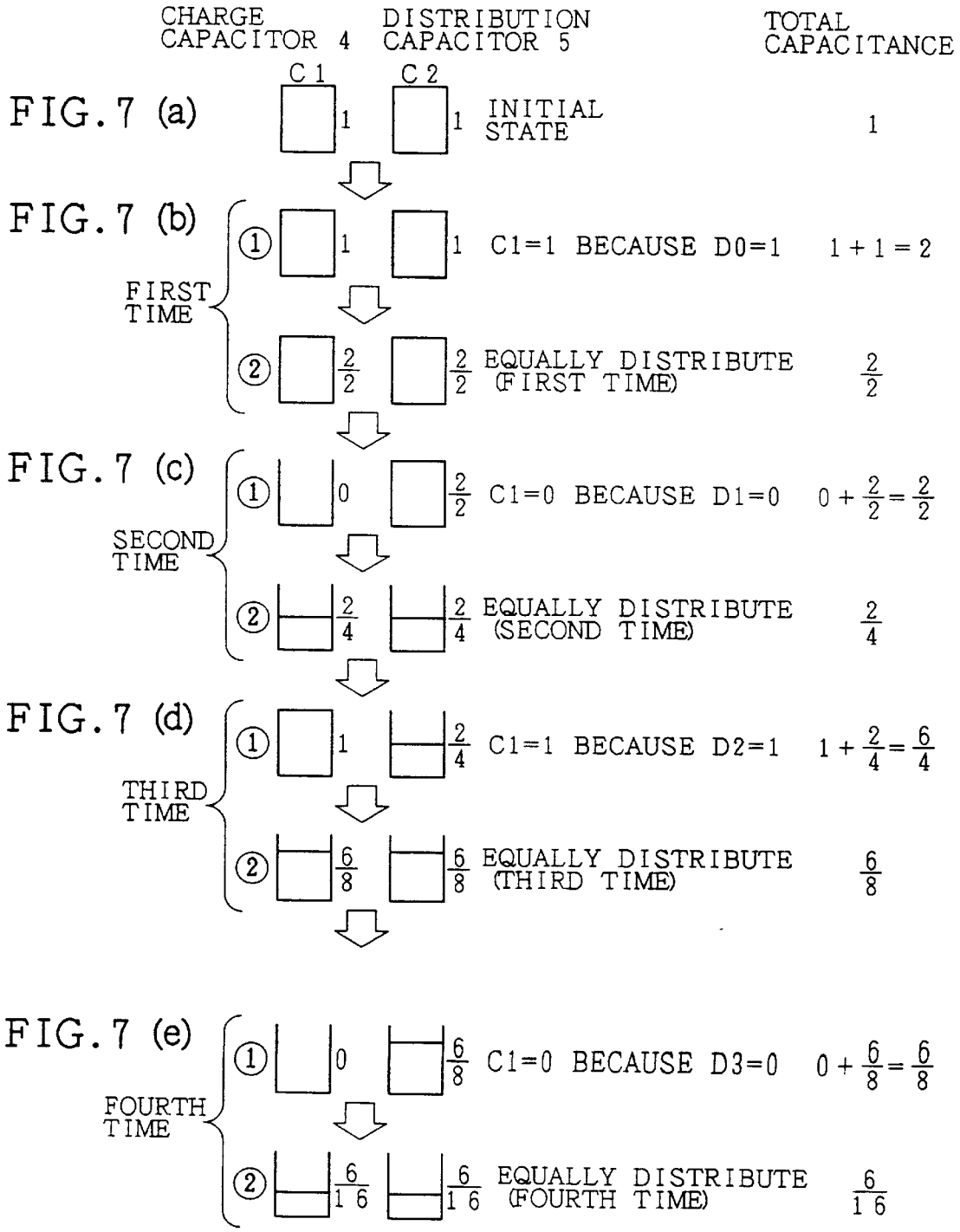
FIG. 7(*a*) through FIG. 7(*e*) are explanatory drawings showing respective states of the charge capacitor and the distribution capacitor in the timing chart of FIG. 6.

It can be seen from this equation that, by the digital signal, 16 different linear analog voltages per (1/16)VREF are obtained, from (1/16)VREF to VREF. FIG. 6 and FIG. 7 illustrate the case where an analog signal corresponding to (6/16)VREF is generated, for example.

Alternatively, as another way of carrying out initialization, the above recurrence formula (2) can be rewritten as follows when SWA and SWND are simultaneously turned ON beforehand and when $V_0=0$ is given as the initial value of $V_0$.

$$V4 = VREF\left(\frac{1}{2}D3 + \frac{1}{4}D2 + \frac{1}{8}D1 + \frac{1}{16}D0\right)$$

Figure 8:
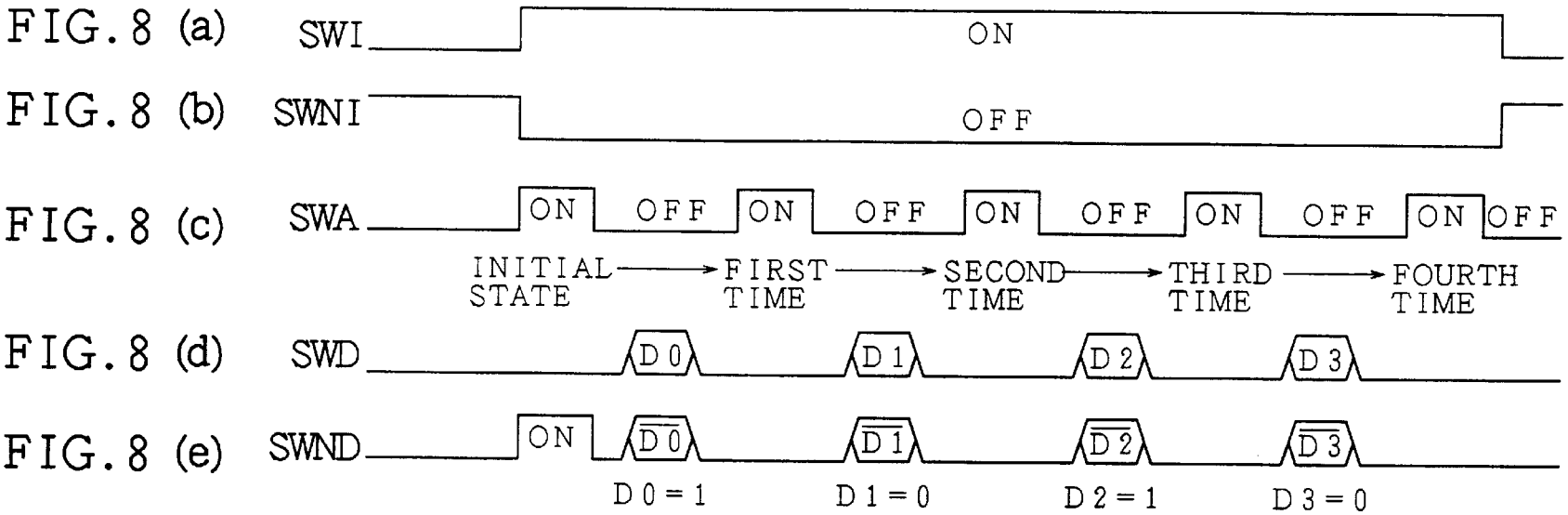
FIG. 8(*a*) through FIG. 8(*e*) are timing chart showing another operation example of the liquid crystal driving circuit.
Figure 9:
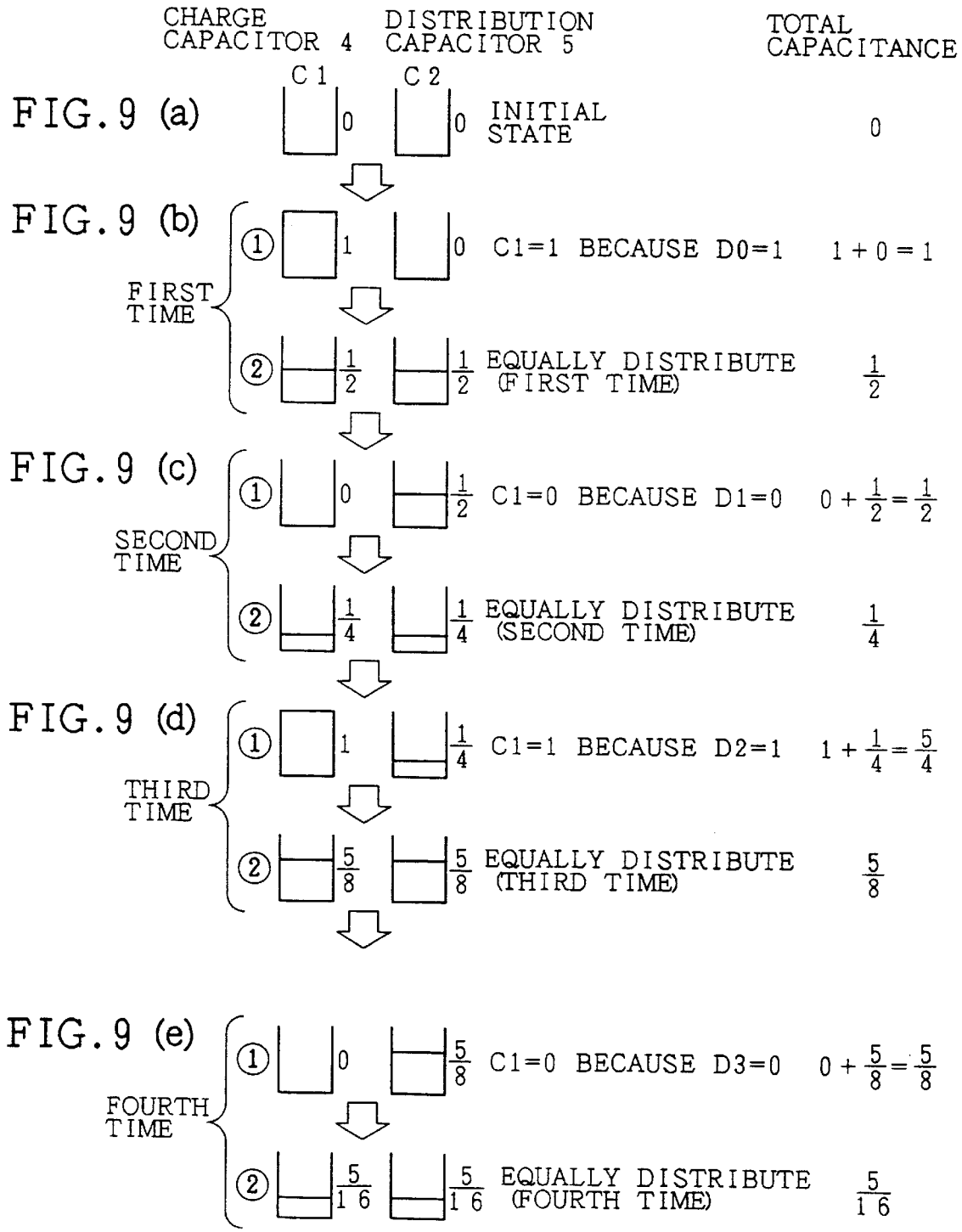
FIG. 9(*a*) through FIG. 9(*e*) are explanatory drawings showing respective states of the charge capacitor and the distribution capacitor in the timing chart of FIG. 8.
Figure 10:
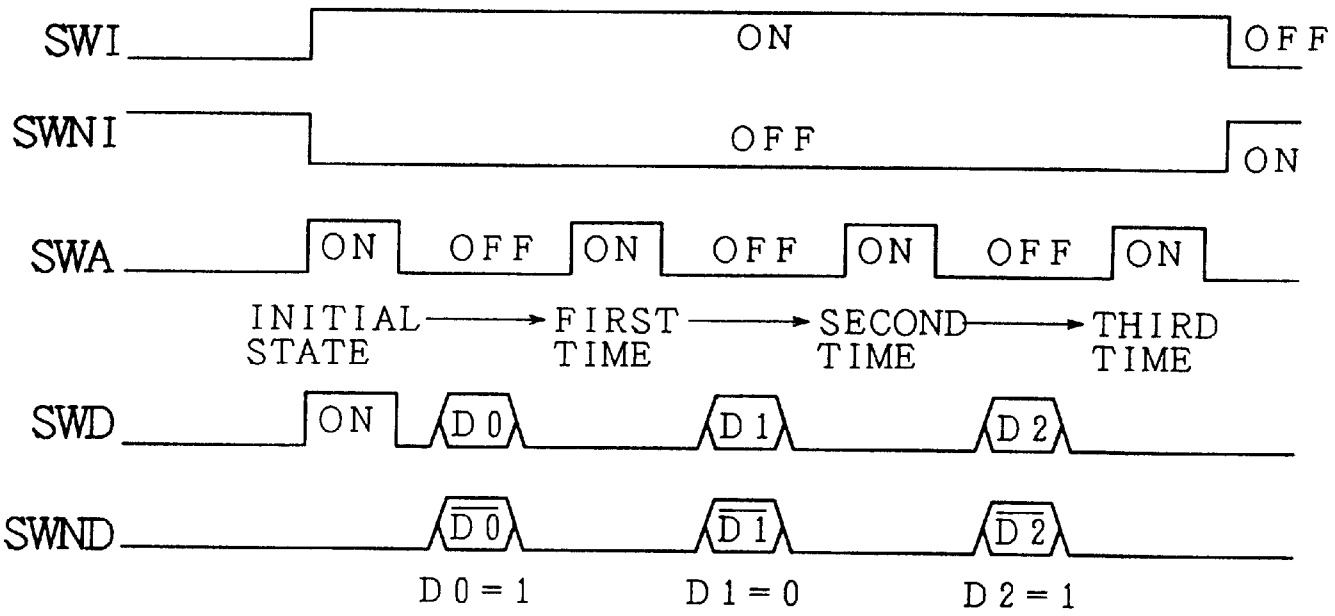
FIG. 10(*a*) through FIG. 10(*e*) are timing chart showing yet another operation example of the liquid crystal driving circuit.
Figure 11:
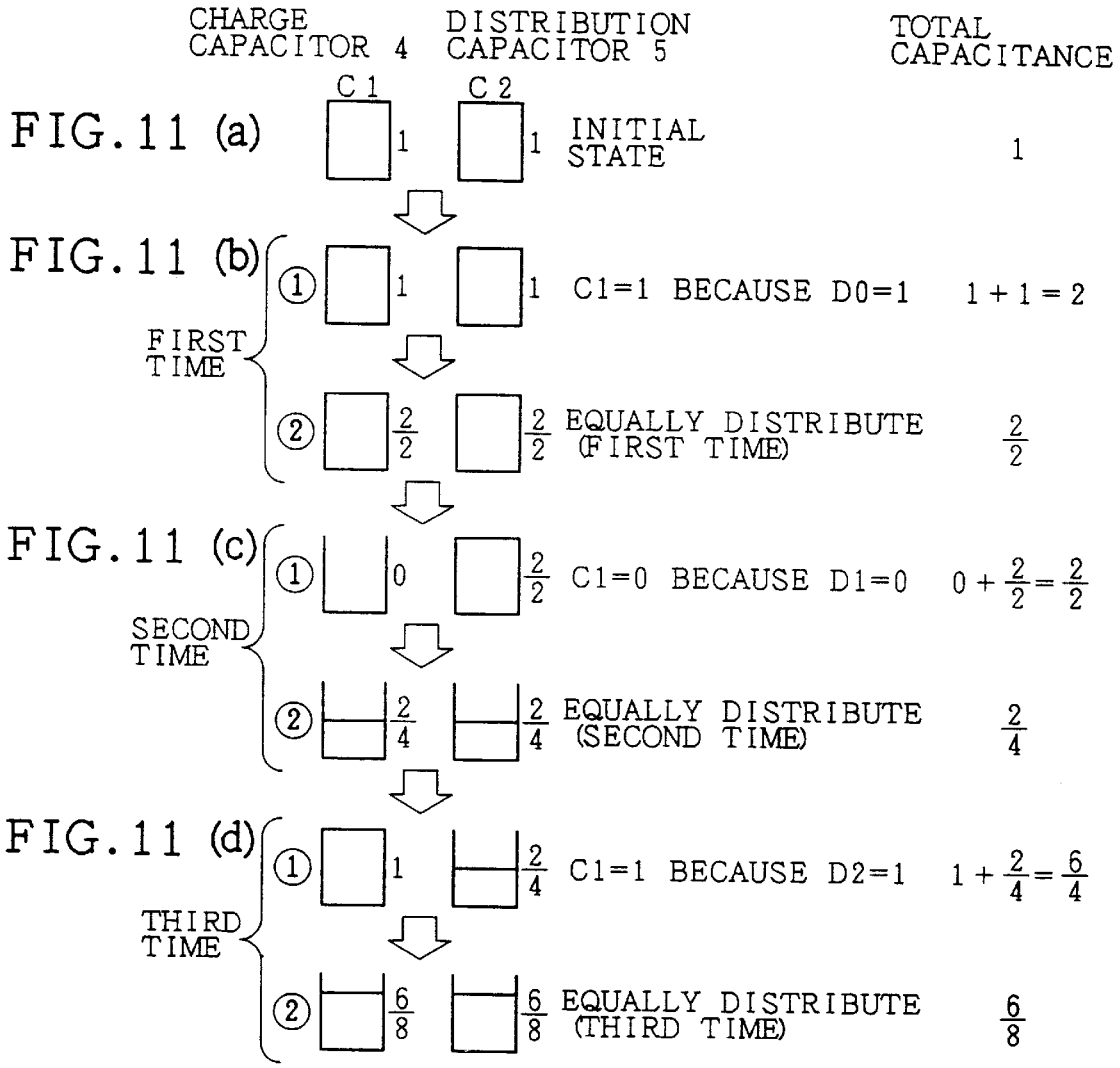
FIG. 11(*a*) through FIG. 11(*d*) are explanatory drawings showing respective states of the charge capacitor and the distribution capacitor in the timing chart of FIG. 10.
Figure 12:
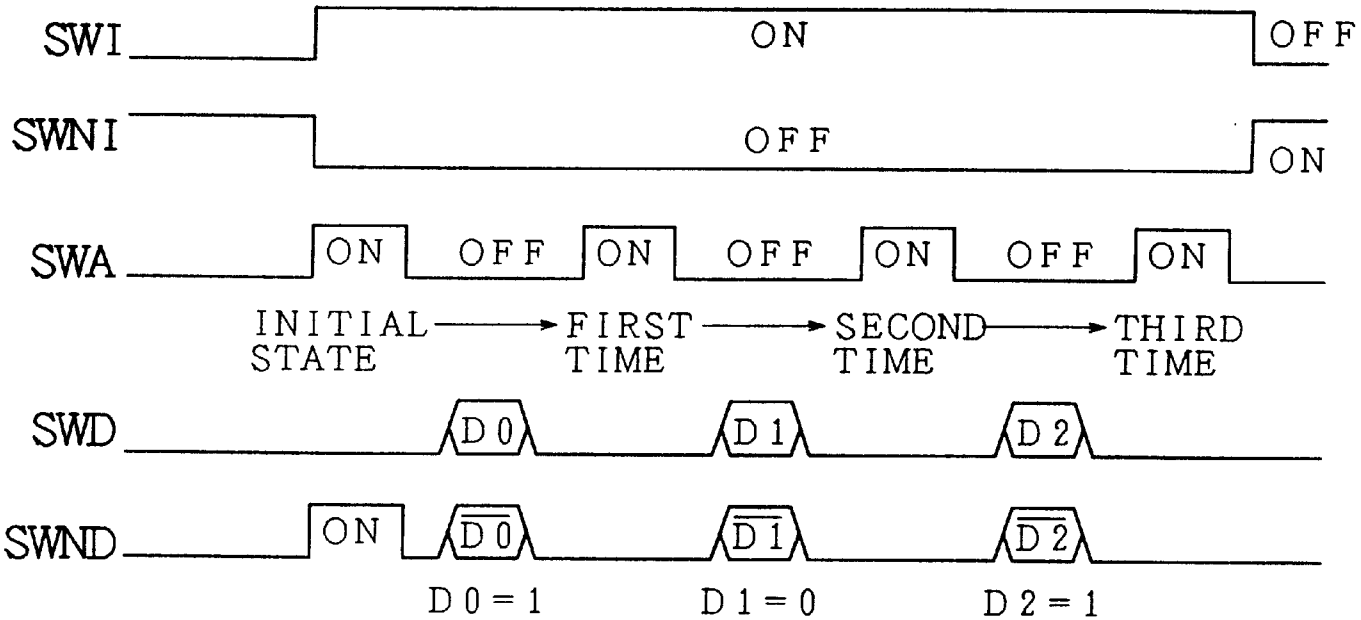
FIG. 12(*a*) through FIG. 12(*e*) are timing chart showing still another operation example of the liquid crystal driving circuit.
Figure 13:
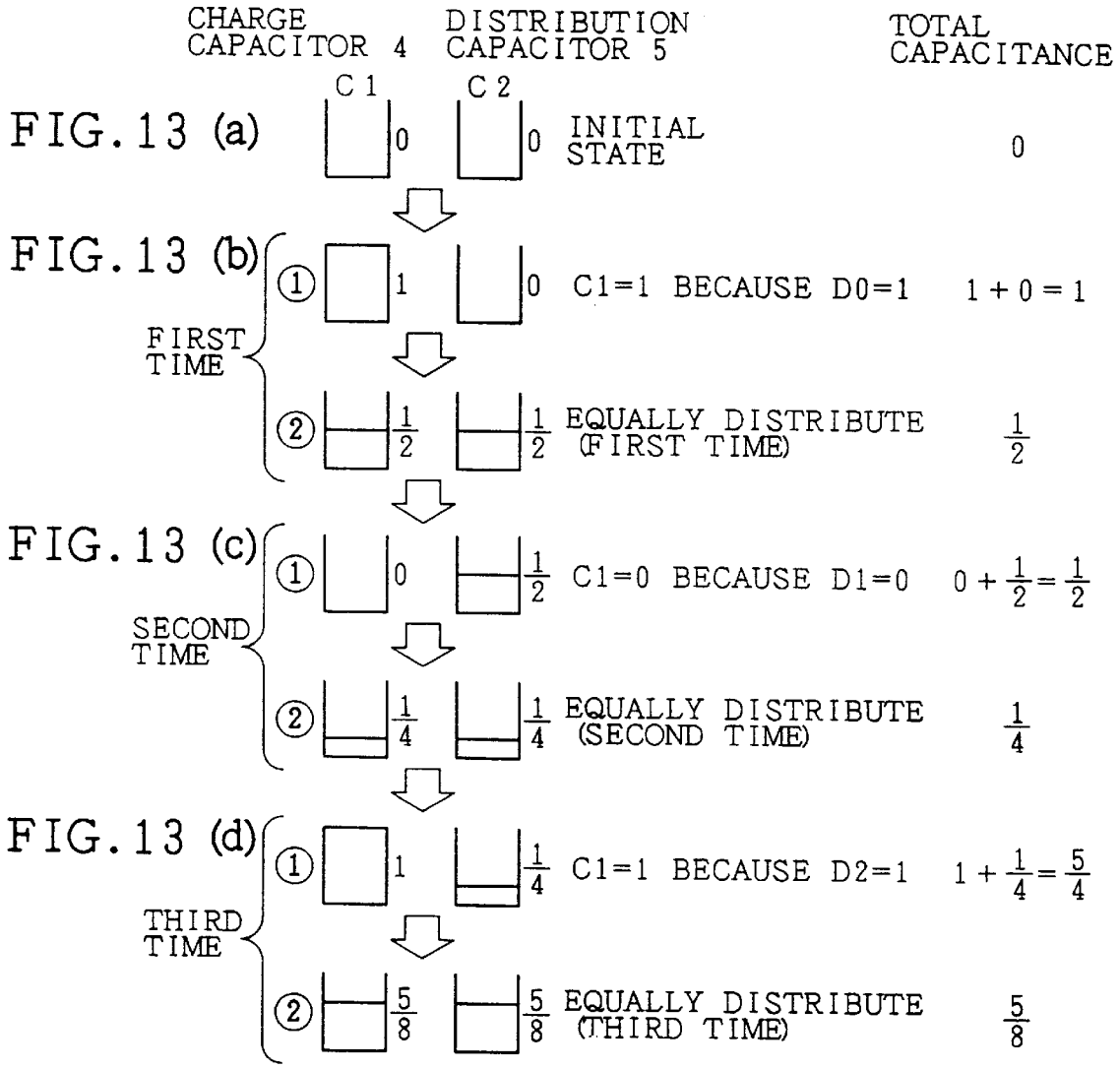
FIG. 13(*a*) through FIG. 13(*d*) are explanatory drawings showing respective states of the charge capacitor and the distribution capacitor in the timing chart of FIG. 12.

Thus, by the digital signal, 16 different analog voltages per (1/16)VREF are obtained, from 0 to (15/16)VREF. FIG. 8 and FIG. 9 illustrate the case where an analog signal corresponding to (5/16)VREF is generated, for example.

These two converted voltages may be selected as desired depending on how initialization is carried out. The output voltage Vout as shown in FIG. 3 is given by $V_{OUT}=Vb+V_4$, and therefore, by the described arrangement, an analog signal which is equally divided into 16 regions between Va and Vb is outputted, using Vb as a reference.

In the liquid crystal driving circuit of the present invention, the output voltage from the operational amplifier 13 is set in accordance with the amount of charge stored in the charge capacitor 4 and in the distribution capacitor 5, and for this reason it is required to carry out initialization every time the output voltage is changed. The section of the circuit as shown in FIG. 2 is initialized in the described manner. The following describes initialization of other part of the circuit, referring to FIG. 1.

In FIG. 1, the switches 7 to 9 remain ON during DA conversion, and the switches 10 and 11 remain OFF during DA conversion. When the switch 9 is turned ON, the operational amplifier 13 as a differential amplifier circuit comes into operation as a voltage follower. At the same time, the switch 8 is turned ON, and as a result the difference of the input and output voltages of the operational amplifier 13 is applied to the correction capacitor 12. This voltage is referred to as a variance ΔV. Although it is ideal that ΔV is "0", ΔV is generally a voltage having a certain dispersion distribution, as caused by manufacturing dispersion, etc. Here, the switches 10 and 11 are turned OFF, and the DA conversion circuit and the operational amplifier 13 are separated from each other and come into operation independently.

After the completion of DA conversion operation, the controller 15 turns OFF the switches 7 to 9, and turns ON the switches 10 and 11. As a result, the variance ΔV of the operational amplifier 13 is stored in the correction capacitor 12, and the distribution capacitor 5, storing the analog voltage which has been subjected to DA conversion, is connected to the correction capacitor 12 in series. These two capacitors function as a feed back circuit of the operational amplifier 13, and the output voltage of the operational amplifier 13 takes the value which is obtained by adding non-inverted input voltage Vb to the sum of DA converted voltage $V_4$ and the variance ΔV. Namely, $Vout=Vb+V_4+\Delta V$.

In this manner, in the present invention, upper M bits, for example, upper 2 bits of a digital signal of N bits, for example, 6 bits is used to select the reference voltages, and remaining lower bits (N−M) of the digital signal, for example, lower 4 bits are used to carry out linear DA conversion, using only two capacitors, that is, the charge capacitor 4 and the distribution capacitor 5, and as a result, as shown in FIG. 14, it is possible to obtain with ease a multi-tone voltage output for driving a liquid crystal panel having a kinked characteristic corresponding to γ correction. Note that, N and M are positive integers, which are set to satisfy N>M.

As a result, in the liquid crystal driving circuit of the present invention, an analog signal for displaying multi-tones can be outputted using a digital signal, which is serially inputted, and using only two capacitors, the charge capacitor 4 and the distribution capacitor 5, and it is also possible to carry out multi-tone display even when the number of tones is increased from 64 tones, as above, to, for example, 128 tones, only by increasing the number of digital bits from 6 to 7, thus preventing a conventional problem, that is, an increase in number of total capacitors, even when the number of tones is further increased, thereby preventing an increase in size and cost of the circuit.

Figure 5:
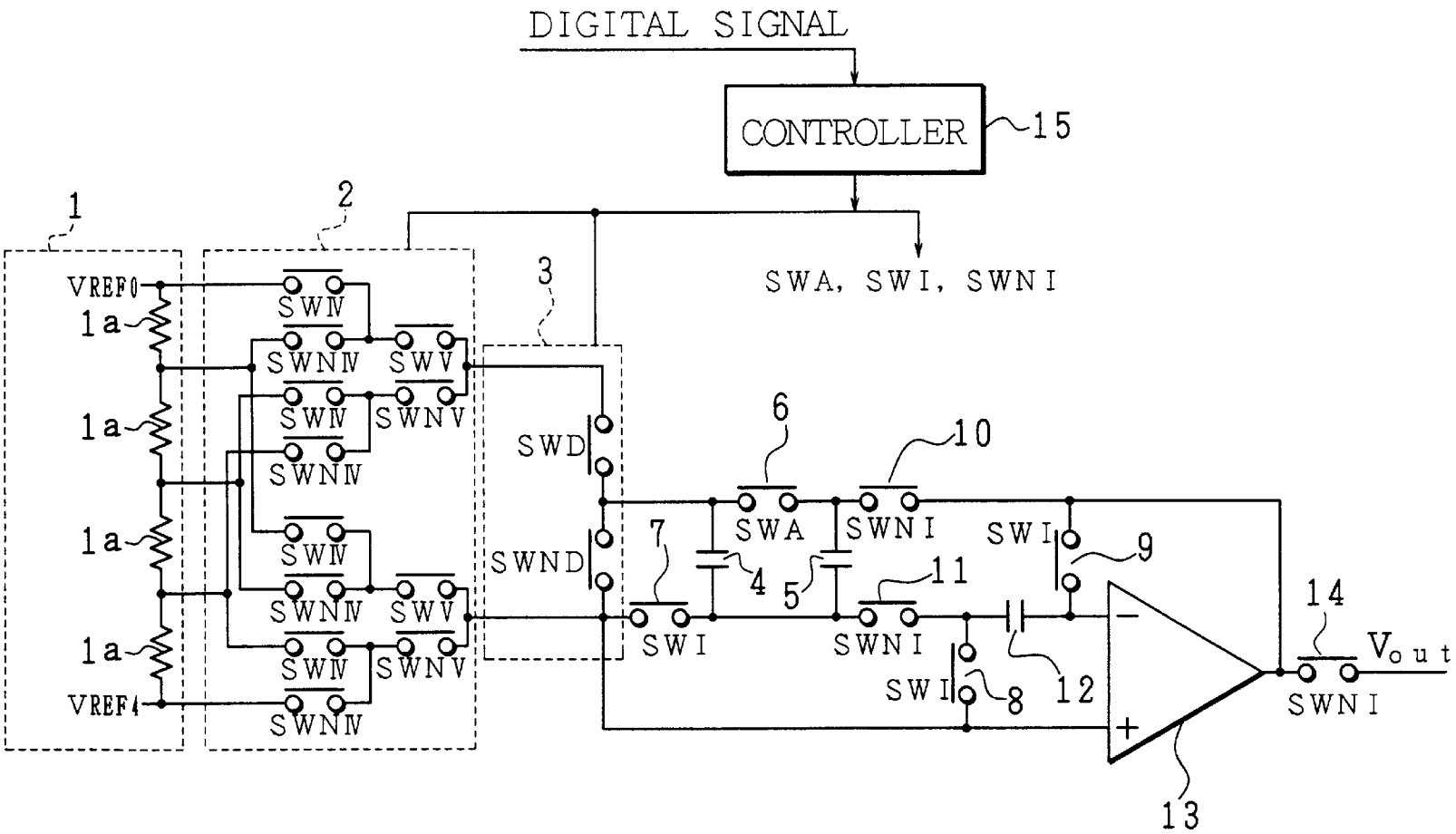
FIG. 5 is a circuit diagram showing a modification example of the liquid crystal driving circuit.

The following describes a modification example of the present invention referring to FIG. 5. In a liquid crystal driving circuit of FIG. 5, in the structure of the liquid crystal driving circuit of FIG. 1, the terminals of the reference voltage input terminal 1 are connected to one another by a plurality of resistances 1*a*, and intermediate reference voltages are generated by the ratios of these resistance values. This reduces the number of external input voltages to just two voltages of a highest voltage and a lowest voltage, thus simplifying an external power source circuit.

Also, in FIG. 5, a switch (seventh switch) 14 is inserted between the output terminal of the operational amplifier 13 and a terminal to be connected to the liquid crystal panel (not shown). The switch 14 simultaneously turns ON or turns OFF the switches 10 and 11, and cuts off the liquid crystal driving circuit of the present invention from the load capacitor of the liquid crystal panel during DA conversion, thus preventing the operation of the liquid crystal driving circuit from being adversely affected by the load capacitor. Therefore, regardless of what kind of load is connected to the liquid crystal driving circuit, a fast operation of the liquid crystal driving circuit is always ensured.

Note that, the above explanations are based on the case where the capacitance of the charge capacitor 4 and the distribution capacitor 5 are the same. However, when it is not required to equally divide the difference between Va and Vb, for example, into 16 regions, it is possible to set different capacitance for the charge capacitor 4 and the distribution capacitor 5.

Also, in the present embodiment, the operation of DA conversion was described using lower 4 bits of a digital signal as an example. However, it is also possible to carry out DA conversion by the described two ways of initialization, as shown in FIG. 10 through FIG. 13, using lower 3 bits of a digital signal.

The invention being thus described, it will be obvious that the same way may be varied in many ways. Such variations are not to be regarded as a departure from the spirit and scope of the invention, and all such modifications as would be obvious to one skilled in the art are intended to be includes within the scope of the following claims.

What is claimed is:

1. A liquid crystal driving circuit, comprising:

a plurality of reference voltage input terminals for inputting a plurality of respective reference voltages;

reference voltage selecting means for selecting and outputting a first reference voltage and a second reference voltage from the plurality of reference voltages, using a digital signal of N bits for multi-tone display;

a first capacitor and a second capacitor, whose respective first electrodes are connected to each other;

a first switch for connecting and disconnecting respective second electrodes of said first capacitor and said second capacitor, which are not connected to each other;

a select switch for selecting and applying one of the first reference voltage and the second reference voltage to the second electrode of said first capacitor in accordance with the digital signal;

a second switch for connecting and disconnecting the second reference voltage with respect to the respective first electrodes of said first capacitor and said second capacitor;

a differential amplifier circuit, whose non-inverted input terminal is connected to the second reference voltage, for outputting from an output terminal an analog signal for multi-tone display that is in accordance with the digital signal;

a feedback capacitor, whose one electrode is connected to an inverted input terminal of said differential amplifier circuit;

a third switch for connecting and disconnecting an other electrode of said feedback capacitor with respect to the respective first electrodes of said first capacitor and said second capacitor;

a fourth switch for connecting and disconnecting the other electrode of said feedback capacitor with respect to the non-inverted input terminal of said differential amplifier circuit;

a fifth switch for connecting and disconnecting the output terminal of the differential amplifier circuit with respect to the inverted input terminal thereof; and a sixth switch for connecting and disconnecting the second electrode of said second capacitor with respect to the output terminal of said differential amplifier circuit.

2. The liquid crystal driving circuit as set forth in claim 1, wherein at least one resistance is provided between at least two terminals of said plurality of reference voltage input terminals so as to generate the plurality of reference voltages.

3. The liquid crystal driving circuit as set forth in claim 1, further comprising a seventh switch for connecting and disconnecting the output terminal of said differential amplifier circuit with respect to a liquid crystal panel to be driven.

4. The liquid crystal driving circuit as set forth in claim 1, wherein said reference voltage selecting means selects the first reference voltage and the second reference voltage by upper M bits of the digital signal of N bits (N>M), and said select switch selects one of the first reference voltage and the second reference voltage by remaining (N−M) bits of the N bit digital signal.

5. The liquid crystal driving circuit as set forth in claim 1, wherein said select switch comes into operation serially with respect to said first switch.

6. A liquid crystal driving circuit, comprising:

a first capacitor and a second capacitor, each having a first electrode and a second electrode, for storing charge by application of a voltage, respective first electrodes of said first capacitor and said second capacitor being connected to each other;

a first switch for connecting and disconnecting respective second electrodes of said first capacitor and said second capacitor;

a select switch for selecting application of a first reference voltage and a second reference voltage applied to the first electrode of said first capacitor with respect to the second electrode of said first capacitor by connection or disconnection;

a conversion circuit for outputting an analog signal for multi-tone display in accordance with an amount of charge of said second capacitor and in accordance with the second reference voltage; and switch controlling means for alternately controlling said first switch and said select switch in accordance with a digital signal for multi-tone display.

7. The liquid crystal driving circuit as set forth in claim 6, further comprising reference voltage selecting means for changing setting of the first reference voltage and the second reference voltage in accordance with the digital signal so as to output the first reference voltage and the second reference voltage.

8. A liquid crystal driving circuit, comprising:

a first capacitor and a second capacitor, each having a first electrode and a second electrode, respective first electrodes of said first capacitor and said second capacitor being connected to each other;

selecting means for selecting whether to apply a potential difference corresponding to a difference between a first reference voltage and a second reference voltage to said first capacitor in accordance with an input digital signal, or to make a potential difference of said first capacitor zero;

distributing means for connecting respective second electrodes of said first capacitor and said second capacitor so as to distribute a charge stored in said first capacitor and in said second capacitor; and controlling means for controlling said selecting means and said distributing means to operate alternately for plural times so that an analog signal in accordance with a voltage of said second capacitor is outputted.

9. The liquid crystal driving circuit as set forth in claim 8, further comprising a reference voltage selecting means for changing setting of the first reference voltage and the second reference voltage in accordance with the digital signal so as to output the first reference voltage and the second reference voltage.

* * * * *